US010399209B2

(12) United States Patent
Zaehnle

(10) Patent No.: US 10,399,209 B2
(45) Date of Patent: Sep. 3, 2019

(54) VISE JAW BASE PLATE ADAPTERS INCLUDING SOFT JAWS

(71) Applicant: Arthur Zaehnle, Redding, CA (US)

(72) Inventor: Arthur Zaehnle, Redding, CA (US)

( * ) Notice: Subject to any disclaimer, the term of this patent is extended or adjusted under 35 U.S.C. 154(b) by 225 days.

(21) Appl. No.: 14/869,631

(22) Filed: Sep. 29, 2015

(65) Prior Publication Data

US 2016/0089767 A1 Mar. 31, 2016

Related U.S. Application Data

(60) Provisional application No. 62/056,702, filed on Sep. 29, 2014.

(51) Int. Cl.
*B25B 1/24* (2006.01)
*B25B 1/20* (2006.01)

(52) U.S. Cl.
CPC ..... *B25B 1/241* (2013.01); *B25B 1/2452* (2013.01)

(58) Field of Classification Search
CPC ..... B25B 1/241; B25B 1/2452
See application file for complete search history.

(56) References Cited

U.S. PATENT DOCUMENTS

| | | | | |
|---|---|---|---|---|
| 4,489,929 | A | 12/1984 | Blechschmidt | |
| 5,197,834 | A * | 3/1993 | Chase | B25B 1/2452 269/282 |
| 5,501,440 | A | 3/1996 | Blise | |
| 6,045,126 | A * | 4/2000 | Brzezinski | B25B 1/2405 269/240 |
| 6,601,839 | B1 | 8/2003 | Collins | |
| 8,540,225 | B2 | 9/2013 | Ehnstrom | |
| 2003/0098538 | A1 * | 5/2003 | Dermody, Jr. | B25B 1/241 269/282 |
| 2013/0277903 | A1 | 10/2013 | Gray | |
| 2014/0284862 | A1 | 9/2014 | Bettencourt | |

* cited by examiner

*Primary Examiner* — John C Hong
(74) *Attorney, Agent, or Firm* — Heisler & Associates

(57) ABSTRACT

Vise jaws are provided with base plates having bolt receiving holes or slots passing therethrough near top edges thereof. Soft jaws formed of a readily machinable material are provided with threaded bores which can receive bolts passing through the holes or slots in the base plates, the bolts also pass into the threaded bores to hold the soft jaws to the base plates. The soft jaws can be provided with a modified contour to match a geometry of a workpiece to be held. A locating pin can cooperate with alignment holes and alignment bores in the base plates and soft jaws for precise alignment of the base plates and soft jaws together. Adapters are also provided which can attach to surfaces of base plates and be rotated to present edges at a variety of different angles for supporting of workpieces in various angled orientations.

15 Claims, 12 Drawing Sheets

VISE JAW BASE PLATE ADAPTERS INCLUDING SOFT JAWS

CROSS-REFERENCE TO RELATED APPLICATIONS

This application claims benefit under Title 35, United States Code § 119(e) of U.S. Provisional Application No. 62/056,702 filed on Sep. 29, 2014.

FIELD OF THE INVENTION

The following invention relates to vises such as those provided on milling machines and other machining equipment. More particularly, this invention relates to base plates for vise jaws which are readily adaptable to hold workpieces of a variety of different shapes in a secure and repeatable fashion, as well as accessories attachable to base plates and modifiable to easily and securely hold workpieces of different shapes within the vise.

BACKGROUND OF THE INVENTION

Machining involves cutting away portions of a workpiece to change the geometric shape of the workpiece. Machining equipment generally include two parts. A first part is a vise for holding the workpiece stationary, and typically resides on a horizontal table at a lower portion of the machining equipment. The second part of the machining equipment is a form of cutter which is movable relative to the workpiece. In some instances the cutter is an end mill bit which rotates and translates laterally, typically along multiple axes, and has cutting edges which cut away material when coming into contact with the workpiece. In other instances, the cutter can be in the form of a drill bit for drilling holes in the workpiece.

The workpiece is typically made of some form of metal, but could be any of a variety of different materials from which the finished article is to be manufactured. The workpiece is formed of a material which is softer than the material from which the cutter is formed, so that the workpiece can be effectively cut and shaped by the cutter. Often the cutter has its position precisely controlled, either through action of a manual operator individual or through numerical control, such as having the cutter position controlled by a computer programmed to have the cutter follow particular paths upon the workpiece.

When multiple identical articles are to be manufactured through a machining process, a significant amount of time associated with the machining operation is involved in "setup" of the machinery so that the workpieces are held precisely where required for effective and accurate machining thereof. Because the variety of geometric cuts which can be made on a workpiece is essentially endless, the optimal configuration of the vise jaw for effective holding of the workpiece during the machining operation is also varies greatly from job to job. Merely popping the workpiece into the vise and tightening the vise on the workpiece is rarely satisfactory. Problems with having the workpiece inadequately held within the vise include movement of the workpiece during machining, resulting in inaccurate cutting and/or damage to the cutter; and excessive vibration resulting in low quality machining of the workpiece and/or damage to the machining equipment. Also, when the workpiece is not adequately held by the vise jaw, significant additional time and skill is required to compensate, resulting in a greater amount of time and effort associated with machining of each workpiece.

In contrast, when the "setup" is optimal for the machining of a particular workpiece, an operator need merely pop the workpiece into the properly set up vise jaw, tighten the vise jaw, push a button to actuate the machine, and then wait for the cutter to complete its operation, before removing the workpiece and inserting a new workpiece. The simplicity associated with a high quality "setup" allows for a lower skill operator to perform the machining operation, and/or allows the operator to multi-task and perform other activities while the cutter is automatically cutting the workpiece (such as planning the next "setup" for other machining operations, keeping the machinery in good working order, communicating with co-workers, and other important tasks), thus greatly improving overall efficiency and quality of the machining process.

A machining vise typically includes a stationary jaw and a moving jaw which support pair of base plates including a stationary base plate and a moving base plate, which are typically oriented in substantially parallel vertical planes facing each other with a gap therebetween. A workpiece is inserted into this gap and the moving base plate is moved toward the stationary base plate until the workpiece is trapped between the base plates within the gap. Perhaps the only time that the basic vise configuration is optimal is when a workpiece of square or rectangular form is to be machined and when the precise position of the workpiece laterally between the vise jaws is not important. In other circumstances, it is desirable that a workpiece be held precisely at a depth between the jaws, and at a precise lateral spacing between the jaws, as well as a distance away from the stationary base plate, and associated angles of orientation, all precisely selected to hold the workpiece where desired during the operation of the cutter upon the workpiece as part of the machining operation.

In these typical situations, it is beneficial to be able to hold the workpiece precisely in the position and orientation desired for optimal machining. Accordingly, a need exists for adapters attachable to base plates of vise jaws which can be readily customized to optimally hold a great variety of different workpieces tightly between the base plates of the vise.

SUMMARY OF THE INVENTION

With this invention, adapters are provided which are attachable to base plates of a machining vise. Initially, the base plates (at least one) are modified (or substituted with modified base plates) in a preferred embodiment to accommodate the adapters. In a first embodiment, two basic types of modified base plates are provided including a standard base plate and a slotted base plate. In some machining operations multiple vises are utilized simultaneously, such as with one slotted base plate pair and one standard base plate pair being utilized in a common machining operation on two adjacent vises. Alternatively, a single vise could be utilized either having a pair of standard base plates, a pair of slotted base plates or one standard base plate and one slotted base plate used together (or keeping one base plate unmodified).

With the standard base plate, two large stepped fastener holes pass through the base plate and receive relatively large bolts or other fasteners which hold the base plate to the stationary jaw or moving jaw of the vise. Importantly, the standard base plate also has a series of holes extending perpendicularly into the face near a top edge of the standard base plate. These holes preferably pass entirely through the base plate and are unthreaded. The holes receive bolts therethrough, with the bolts long enough that threaded tips of the bolts (or other fasteners) extend from a rear of the base plate through the face of the base plate so that the bolt tip remains available to engage an adapter attached to the face of the base plate.

One form of adapter is a soft jaw having a series of threaded holes or bores extending into a surface thereof with female threads sized to be engaged and held by the threads of the bolts (or threaded fasteners). These threaded holes in the soft jaws are spaced apart a standard spacing which matches spacing between the holes passing through the top edge of the base plate. In this way, one or more bolts can pass through the holes in the base plate and threadably engage in the threaded holes of the soft jaw in a variety of different positions to hold the soft jaw to the base plate. Typically, similar base plates are provided on the stationary jaw and moving jaw and at least one of the base plates has a soft jaw attached thereto, while typically each base plate has a soft jaw attached thereto.

The soft jaws are formed of aluminum or other easily machinable material. The soft jaws are thus readily machined themselves to be customized into a shape which is optimal for holding of a particular workpiece. In one example, each soft jaw has a step cut into the soft jaw which extends along an entire length of the soft jaw. An elongate thin workpiece can thus be securely held by such a pair of soft jaws between the moving jaws of the vise. In other embodiments circular cuts can be made in the soft jaws with a diameter and other contour details which match surfaces of a workpiece to be securely held by the vise. For instance, if an end of a generally cylindrical object is to be machined, the soft jaws can be cut with circular contours to match the cylindrical surfaces of the workpiece and presenting the end to be machined up above the vise jaw where a cutter of appropriate machining equipment can readily access the workpiece for cutting thereon.

The soft jaws can initially be provided in long lengths but then be readily cut into shorter lengths, depending on the particular needs of the operator. The soft jaws would be provided in various different standard sizes such as half inch square or three-quarter inch square cross-sections and with various different spacings between threaded holes. Most preferably, hole and thread sizes for the threaded holes in the soft jaws are selected to match most common bolt (or other threaded fastener) sizes in the machining environment, so that the soft jaws are conveniently attached to the base plates and held securely thereto by readily available fasteners. The soft jaws are easily customized into a perfect shape for optimal holding of the workpiece, allowing the set up to be re-used repeatedly in a simple and reliable manner.

In a further embodiment, a slotted base plate is shown. The slotted base plate is similar to the standard base plate except that slots are provided rather than holes near an upper edge of the slotted base plate. The slotted base plate receives bolts (or other threaded fasteners) passing therethrough which then thread into threaded holes in the soft jaw. The slotted base plates provide some degree of lateral adjustability of the soft jaw in its position relative to the base plate and overall vise position. In particular, the bolts can initially be somewhat loose and allow the soft jaws to slide laterally within the slots in the slotted base plate. Once the position of the soft jaw is precisely where desired, the bolts are tightened and the soft jaws are then fixed in this position relative to the slotted base plate. The combination of a standard base plate on a first vise and a slotted base plate on a second vise avoids a problem which might otherwise be created where a distance between two vises is different than a standard spacing between the threaded holes in the soft jaws.

In another embodiment, an additional and typically larger hole is provided passing through the base plate, for accommodating a locating pin. These alignment holes in the base plates, have a slip fit with the locating pin so that the base plates can be precisely aligned before tightening to the vice jaws. Similarly, the soft jaws can be provided with an alignment hole therein which has a diameter similar to that of the locating pin, typically with a slip fit, so that the soft jaws can be aligned before tightening.

Such a locating pin aligns with a locating notch in the stationary jaw or moving jaw so that the base plates are precisely positioned relative to the stationary jaw or moving jaw. In a separate alignment step, the locating pin passes through the alignment holes in the soft jaws and the soft jaws can be moved laterally slightly to accommodate precise orientation relative to each other through action of the alignment holes and the locating pin. Once the soft jaws are positioned precisely where desired, the threaded fasteners are tightened so that the soft jaws are firmly attached to the base plates. The locating pin can then be taken out and an operator has confidence that the soft jaws are positioned precisely where required. While such precise positioning is not important when the soft jaws have a contour which is constant between ends thereof, such positioning is important when non-constant contours are cut into the soft jaws, such as circular contours.

To facilitate lateral sliding of the soft jaws, but keeping the soft jaws precisely positioned vertically, guide pins can be provided extending from the face of the base plate perpendicular to this base plate face, and reside within slots in the soft jaw. In such a configuration, the soft jaws have both threaded holes for receiving the bolts passing through the base plates, and also has guide slots for alignment with the guide pin. The guide slots in the soft jaws facilitate some lateral movement of the soft jaws relative to the base plate. The locating pin is utilized to position the soft jaws precisely where desired, while the guide pins keep the soft jaws in fixed position vertically. When the soft jaws are precisely positioned where desired, then the fastening procedure, involving tightening of the bolts, can occur to fix the soft jaws to the base plates.

While the base plates are shown with standard holes therein, they could be slotted base plates. Furthermore, a combination of soft jaws with some slots and soft jaws with no slots could be utilized in pairs so that one soft jaw is in fixed position, such as relative to a standard base plate, and a second soft jaw with slots therein can be utilized along with a slotted base plate to allow for adjustment and then tightening.

Another alternative base plate is provided which has a relief opening in a lower central portion thereof having a stepped contour. A series of holes along an upper edge of the alternate base plate cooperate with a soft jaw in a manner similar to that depicted in previous embodiments described above.

Other adapters, distinct from the soft jaws, or potentially utilizable along with the soft jaws are also provided for attachment to base plates of vise jaws for optimal holding of a work piece during various different customized setups. For instance, a 30° adapter is provided which has a 30° surface and a 60° surface opposite a diagonal (hypotenuse) surface. A series of holes pass laterally through the adapter and into edges thereof. Typically, two or more fasteners are utilized in two different holes in the 30° adapter to securely attach the adapter to the base plate. One of the surfaces such as the 30° surface or the 60° surface are then presented to securely position a workpiece at a desired angle. The 30° adapter can also be rotated to cause the 30° surface or the 60° surface to be horizontal or vertical, to provide a vertical or horizontal support surface.

A base plate is provided such as a further alternative multi-hole base plate which preferably has a large number of holes in a generally square or rectangular spacing pattern into a face thereof. An uppermost row on the second alternative base plate can feature holes having a different spacing such as that matching the threaded holes in soft jaws so that this alternative base plate can be utilized with soft jaws as well as the 30° adapter (or other adapters) either alone or in combination.

Most preferably, edges of the 30° adapter also have threaded holes therein which can have threaded guide pins threaded thereinto which can then reside within holes in soft jaws or can act as stops against which a workpiece can rest. In other embodiments, holes in the workpiece itself can be utilized for direct attachment of the workpiece to one of the adapters through these holes. Spacing of the holes in the 30° adapter are carefully selected to optimize utility of the 30° adapter and the different ways that it can be attached to a base plate such as the alternative base plate.

A 90° adapter is also provided. The 90° adapter is similar to the 30° adapter except that it has different angular measurements between the various sides, most preferably a 45° angle at two corners thereof and a 90° angle at one corner thereof. Most typically, a hole near the 90° corner is referred to as a pivot hole and can receive a fastener which fastens the 90° adapter to the base plate. The 90° adapter also preferably includes a curving slot therein which has a center of curvature aligned with the center of the pivot. The curving slot has a shoulder therein which can hold to a head of a threaded fastener in a preferred embodiment, which can be placed into one of the holes in the base plate. Thus, the 90° adapter can be pivoted about the pivot hole into a variety of different angular positions and be securely attached by a second fastener passing through the curving slot and into one of the threaded holes in the base plate to securely hold the 90° adapter in a variety of different positions relative to the base plate.

Edges of the 90° adapter are preferably perpendicular to faces of the 90° adapter so that these edges present surfaces upon which a workpiece can rest. These edges can be oriented at a variety of different angles for holding of the workpiece in various different desired positions.

A 45° adapter is provided which is similar in shape to the 90° adapter, but has a curving slot which is located somewhat closer to the pivot hole and arcs a full 90° about the pivot hole to support various different orientations of the 45° adapter relative to a base plate. The curving slot is otherwise similar in form with the 45° adapter as the curving slot provided with the 90° adapter. Edges of the 45° adapter and 90° adapter adjacent corners thereof are preferably beveled somewhat to maximize an amount of rotation which can occur about the pivot hole of each adapter without interfering with other portions of the vise jaw.

Objects of the Invention

Accordingly, a primary object of the present invention is to provide adapters, soft jaws and other attachments to base plates of vise jaws to facilitate optimal holding of a workpiece during machining thereof.

Another object of the present invention is to provide accessories for a machining vise to allow a variety of different workpieces to be quickly and securely held for machining thereof.

Another object of the present invention is to provide a method for holding a workpiece which provides soft jaws and other accessories which can be customized in shape or orientation to optimally hold the workpiece.

Another object of the present invention is to accelerate the process of attaching a workpiece to a machine for rapid machining of the workpiece.

Another object of the present invention is to provide a method for precisely holding a workpiece during machining thereof.

Another object of the present invention is to provide a method for securely holding a workpiece during machining thereof.

Another object of the present invention is to provide modified base plates and soft jaws which attach together and which can be customized for holding of workpieces of particular geometries.

Another object of the present invention is to provide base plates of a vise jaw which can have accessories removably attachable thereto in a variety of different configurations for simple and secure holding of workpieces of a variety of different geometries.

Another object of the present invention is to provide a system for securely holding a workpiece within a vise jaw for machining of the workpiece.

Another object of the present invention is to provide vise jaws with base plates that can have soft jaws attached thereto, the soft jaws being readily machinable to include modified contours matching portions of a workpiece to be held, to facilitate custom supporting of workpieces having different geometries.

Other further objects of the present invention will become apparent from a careful reading of the included drawing figures, the claims and detailed description of the invention.

DESCRIPTION OF THE PREFERRED EMBODIMENT

Figure 1:
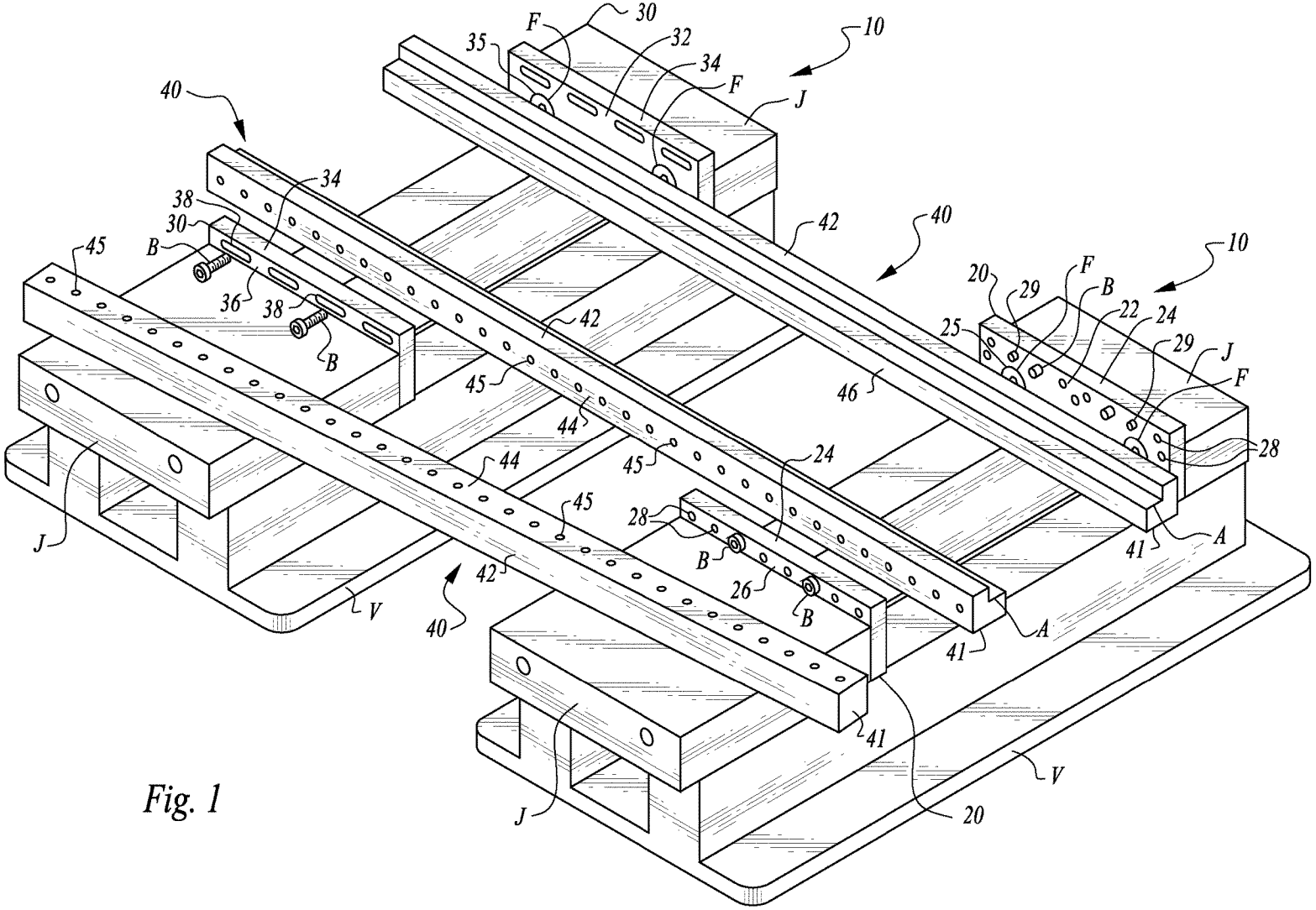
FIG. 1 is a perspective view of a pair of vises modified according to this invention to include standard or modified base plates and utilizing soft jaws.

Referring to the drawings, wherein like reference numerals represent like parts throughout the various drawing figures, reference numeral 10 is directed to a vise adapter system (FIGS. 1 and 2) which includes various base plates 20, 30, 50, 80, 90 attachable to jaws J of a vise V for holding of a workpiece W. The system 10 in at least one embodiment features soft jaws 40 which can be provided with a modified contour matching a portion of the workpiece W to be held, such that quick, secure and accurate holding of the workpiece W can be achieved.

Figure 2:
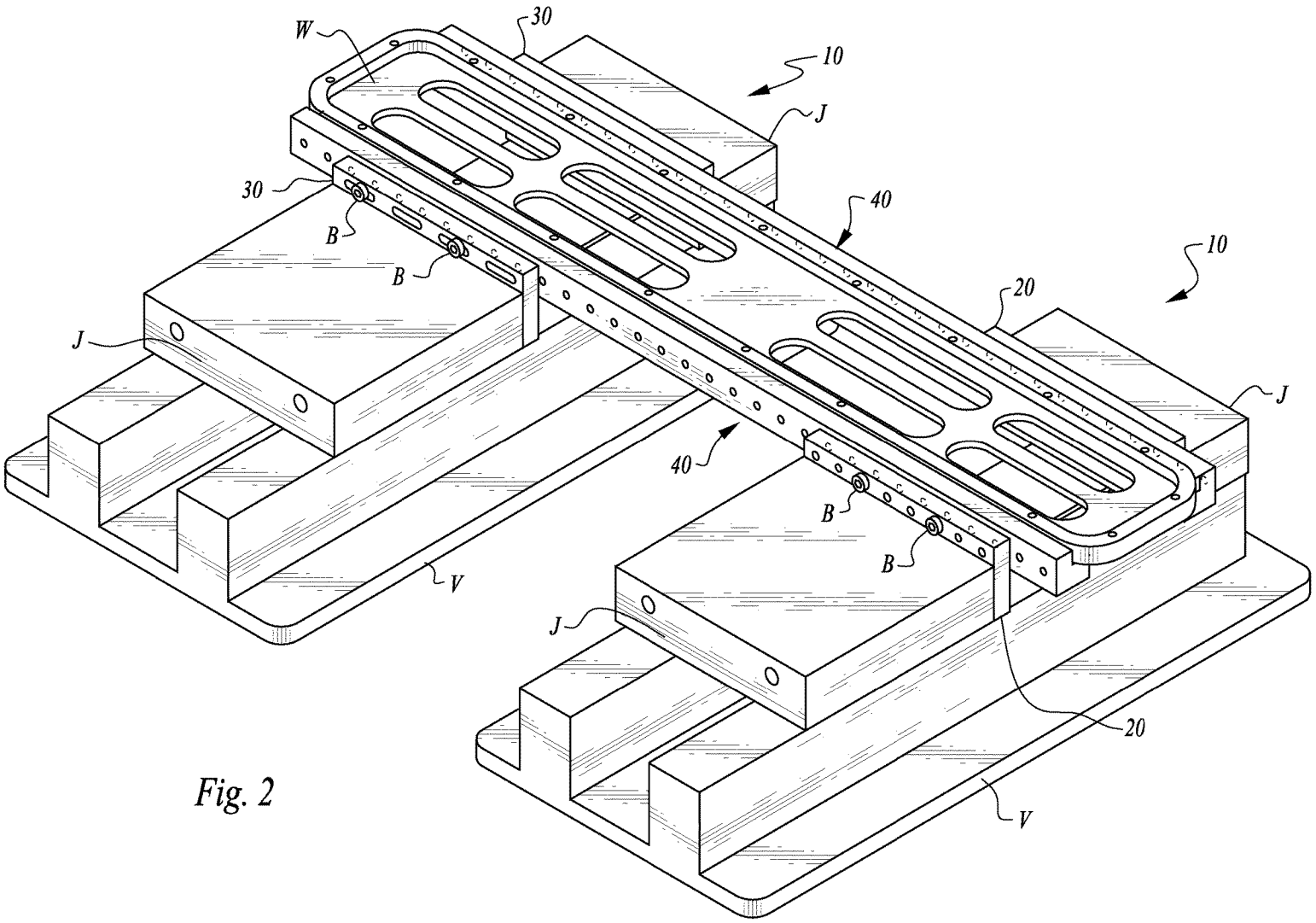
FIG. 2 is a perspective view of that which is shown in FIG. 1 after the vise jaws have been closed onto a workpiece for secure holding of the workpiece before machining thereof.
Figure 3:
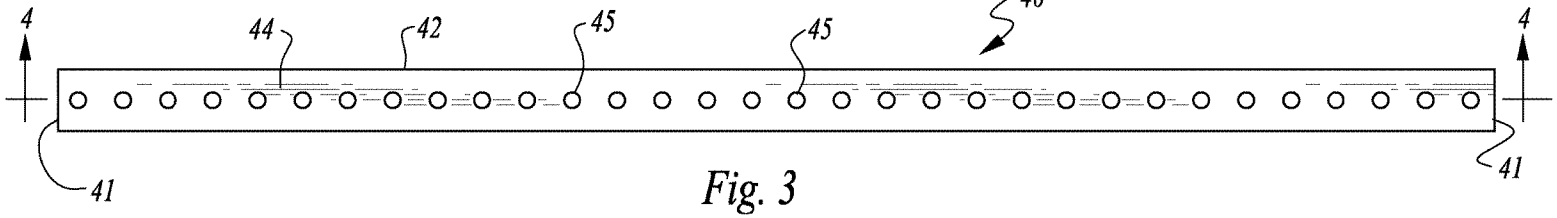
FIG. 3 is a rear elevation view of a soft jaw according to one embodiment of this invention, which can be itself machined to include modified contours matching portions of a workpiece to be held.
Figure 4:
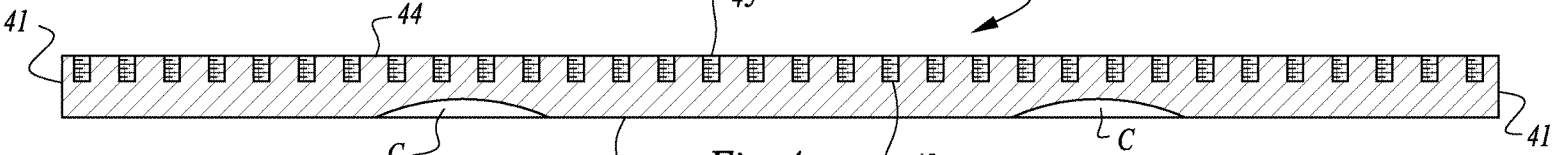
FIG. 4 is a full sectional top plan view taken along lines 4-4 of FIG. 3 of the soft jaw with optional circular modified contour features cut thereinto.
Figure 5:
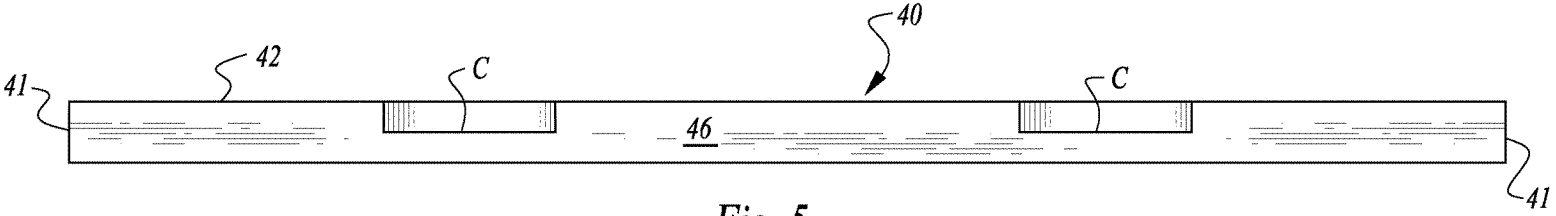
FIG. 5 is a front elevation view of the soft jaw of FIG. 3 and further showing circular modified contour features cut thereinto.

In essence, and with particular reference to FIGS. 1 and 2, basic details of the system 10 are described, in initial embodiments. The system 10 works with a vise V having multiple jaws J including a stationary jaw J and a moving jaw J. Various base plates are attachable to these jaws J. In the system 10 depicted in FIGS. 1 and 2 a pair of vises V are provided adjacent to each other, but vises V could be utilized singularly or in groups of more than two. In this first example, one of the vises V has jaws J thereof fitted with standard base plates 20, while the other vise V has slotted base plates 30 attached to jaws J of the other vise V. The standard base plate 20 and slotted base plate 30 have faces parallel with each other to facilitate holding of a workpiece W therebetween. At least one soft jaw 40 (and typically two soft jaws 40) is provided adjacent to one of the plates 20, 30.

The soft jaws 40 are preferably formed of a softer material than that from which the base plates 20, 30 are formed. Soft jaws 40 can be readily machined or otherwise cut or shaped to have a modified contour matching a geometry of a portion of a workpiece W to be held thereby. The soft jaws 40 thus present a surface for holding of the workpiece W which matches a geometry of the workpiece W, for secure and precise holding of the workpiece W where desired for machining on the workpiece W.

Figure 10:
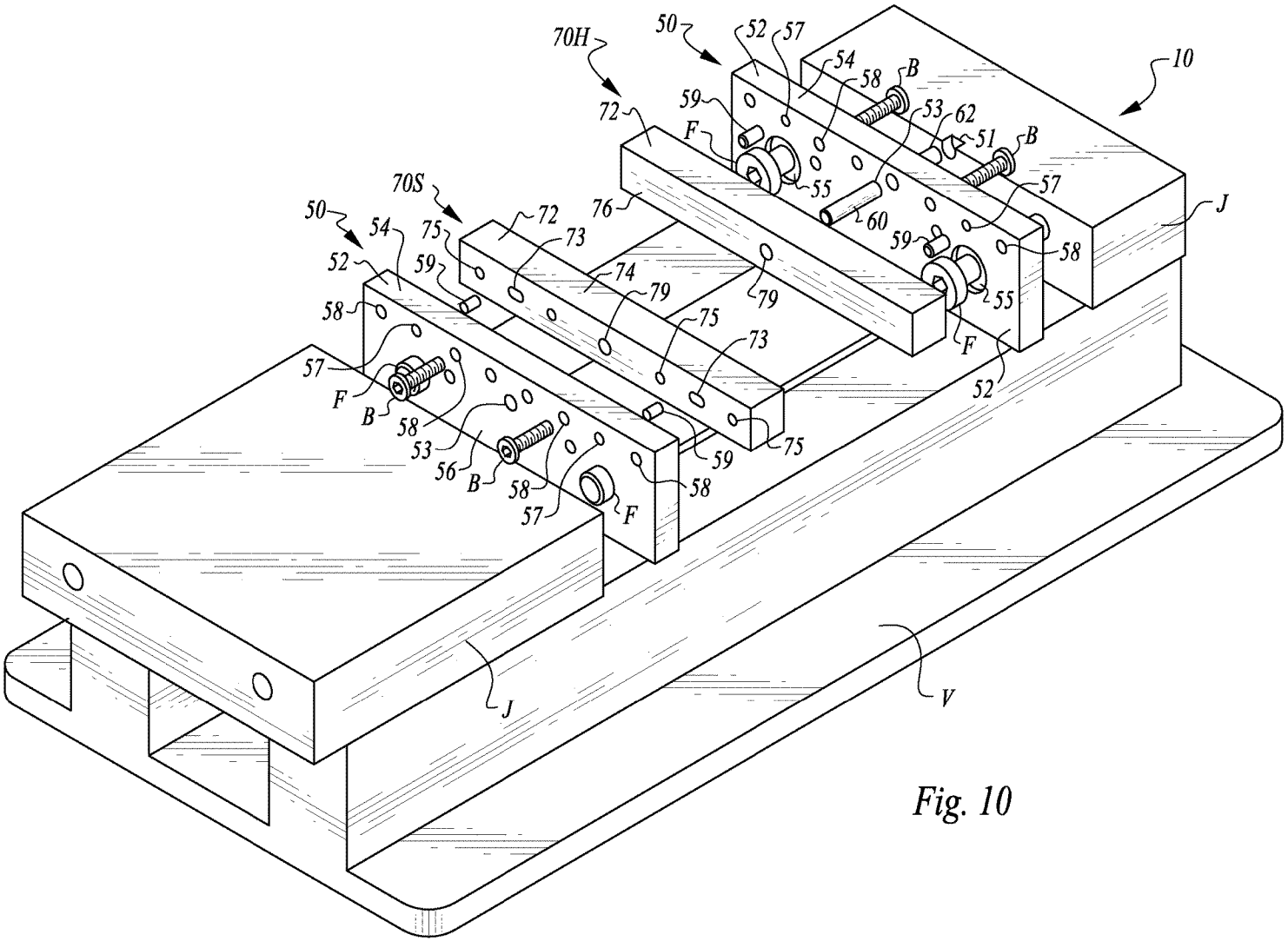
FIG. 10 is a perspective view of a vise with a modified alignment base plate on either side of the vise and with a soft jaw pair and locating pin provided for alignment of the base plates together and for alignment of the soft jaws together.
Figure 11:
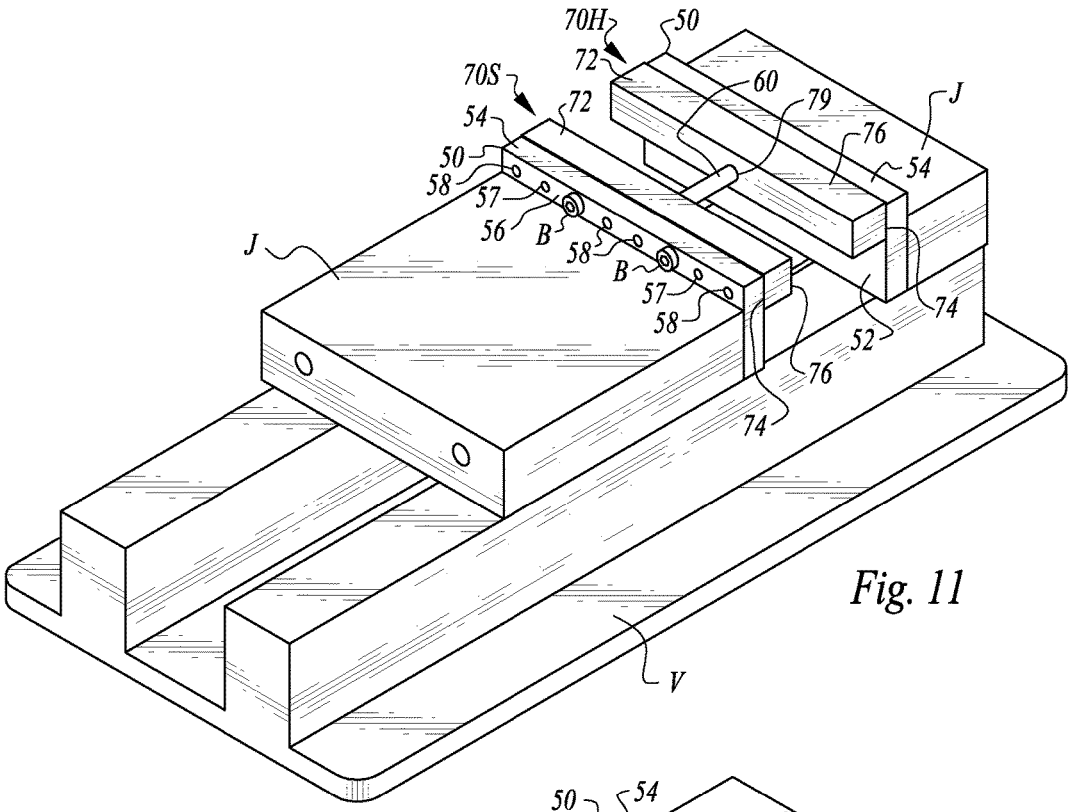
FIG. 11 is a perspective view of that which is shown in FIG. 10, with the vise shown closed and the base plates and soft jaws all aligned together with the locating pin.
Figure 12:
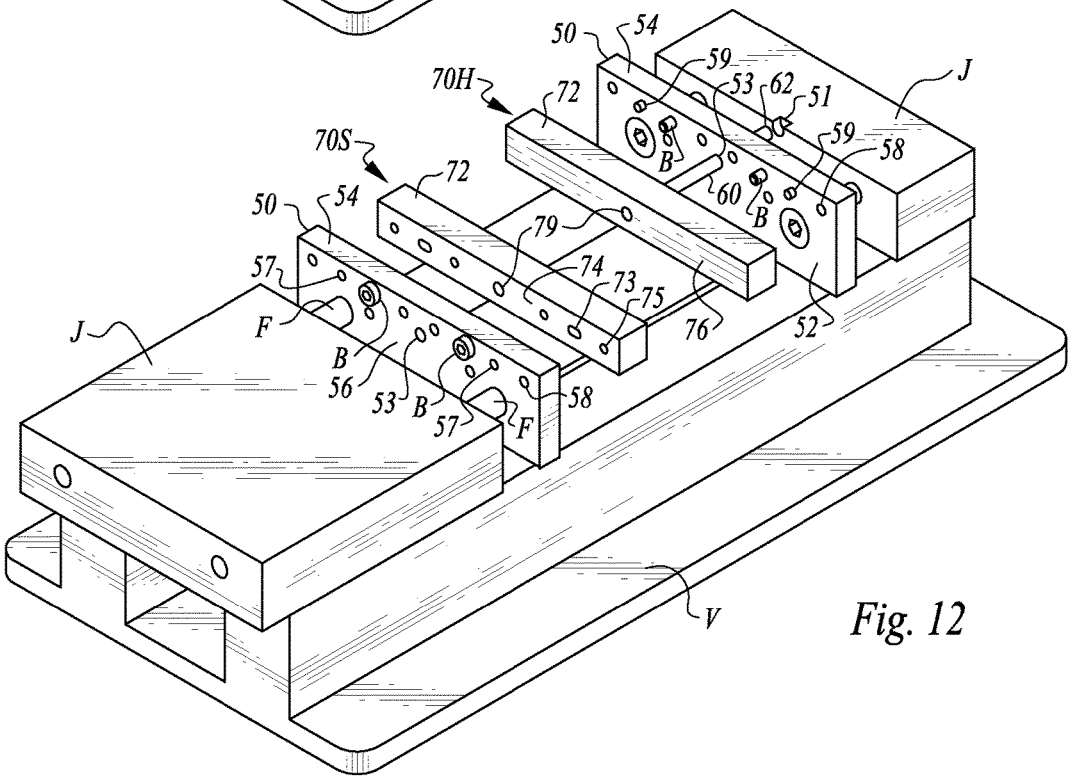
FIG. 12 is a perspective view of that which is shown in FIG. 11, but with the various subassemblies exploded away from each other and further revealing how the alignment base plate, locating pin and slotted soft jaws can be aligned together in a rapid and convenient fashion.
Figure 13:
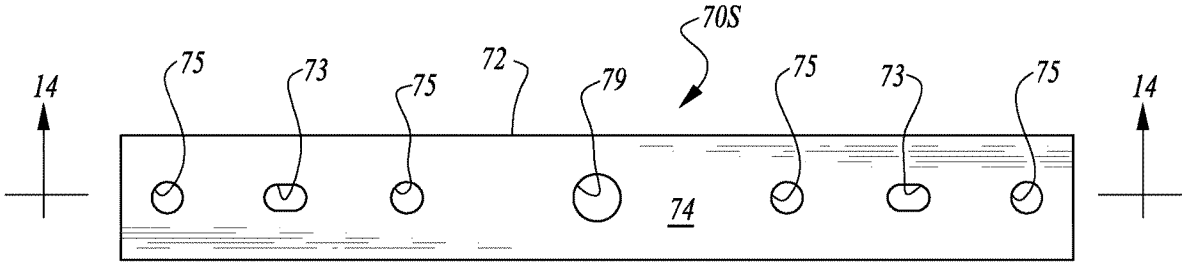
FIG. 13 is a rear elevation view of a slotted soft jaw alternative to that which is shown in FIGS. 3-6, featuring both an alignment bore and alignment slots along with the threaded bores.
Figure 14:
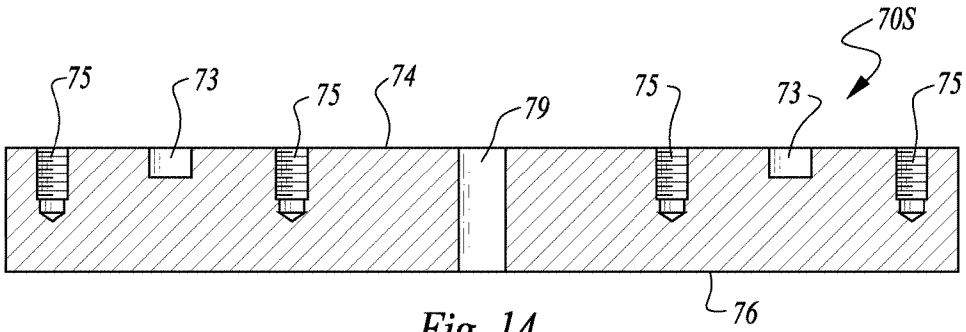
FIG. 14 is a full sectional bottom plan view of that which is shown in FIG. 13, taken along lines 14-14 of FIG. 13.
Figure 15:
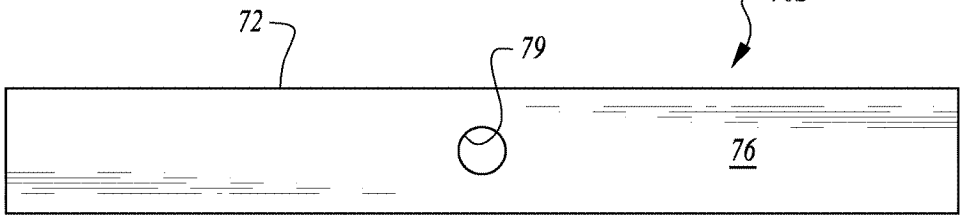
FIG. 15 is a front elevation view of that which is shown in FIGS. 13 and 14.
Figure 16:
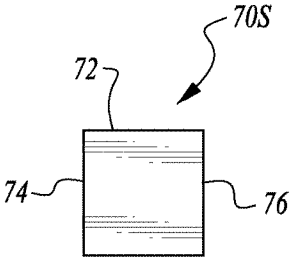
FIG. 16 is an end elevation view of that which is shown in FIGS. 13-15.
Figure 17:
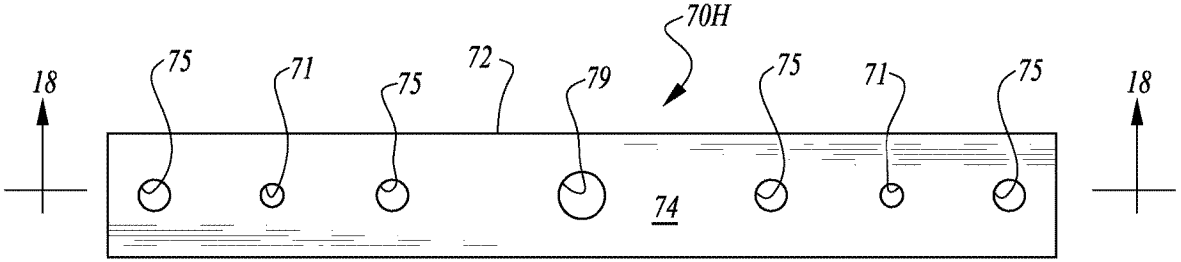
FIG. 17 is a rear elevation view of a variation on the slotted soft jaw of FIG. 13, where pin bores are provided rather than alignment slots.
Figure 18:
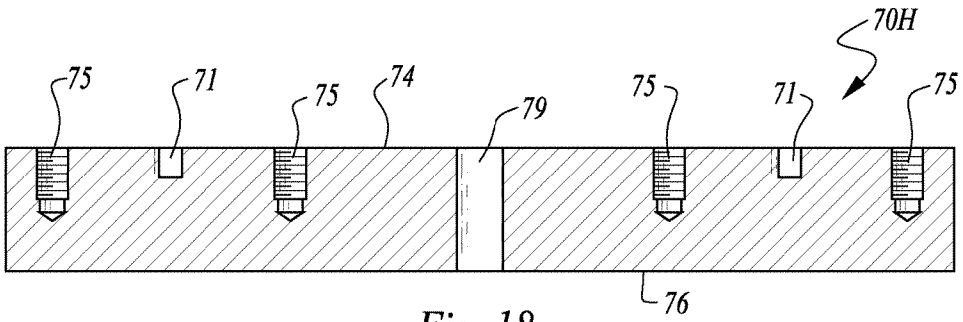
FIG. 18 is a full sectional bottom plan view of that which is shown in FIG. 17, taken along lines 18-18 of FIG. 17.
Figure 19:
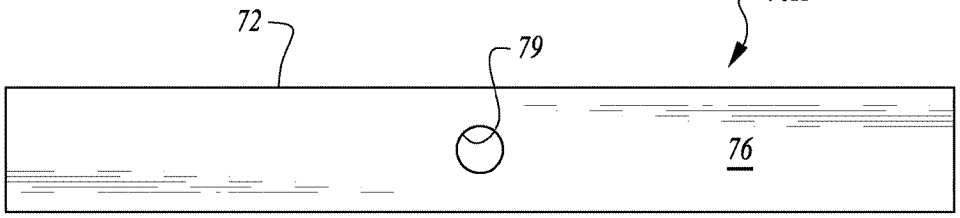
FIG. 19 is a front elevation view of that which is shown in FIG. 17.
Figure 20:
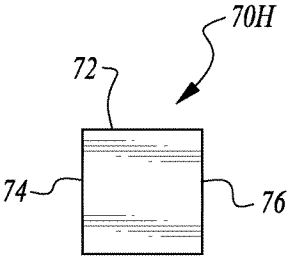
FIG. 20 is an end elevation view of that which is shown in FIG. 17.

Features for alignment of the base plates together are described in conjunction with an alignment base plate (FIG. 10-12) and associated locating pin 60 and slotted soft jaw 70. Other variations disclosed herein include an arched base plate 80 and a multi-hole base plate 90. The various base plates can alternatively have adapters 110, 130, 150 (FIGS. 23-30) attached thereto as an alternative to the soft jaws 40, 70 or in addition thereto. The adapters 110, 130, 150 can be pivoted to present edges at different angles for support of workpieces W which benefit from being angled relative to horizontal.

More specifically, and with particular reference to FIGS. 1, 2 and 7-9, basic details of the standard base plate 20 and slotted base plate 30 are described, according to a preferred embodiment. The standard base plate 20 and slotted base plate 30 preferably have a similar construction except that bolt holes 28 of a cylindrical form are provided in the standard base plate 20 and slots 38 of an elongate horizontally-extending form are provided in the slotted base plate 30. Otherwise, the standard base plate 20 and slotted base plate 30 are preferably substantially identical. Thus, the standard base plate 20 and slotted base plate 30 are described together.

These base plates 20, 30 include a face 22, 32 which is planar and configured to be parallel and spaced from a face of a corresponding opposite base plate coupled to an opposite jaw J of the vise V. Each base plate 20, 30 includes a top edge 24, 34 defining an uppermost portion of the base plate 20, 30. A rear 26, 36 of each base plate 20, 30 is provided opposite the face 22, 32. Fastener holes 25, 35 extend through the face 22, 32 to the rear 26, 36 which accommodate fasteners F which then thread into threaded holes in the jaws J.

The fasteners F are typically in the form of threaded bolts which pass through these fastener holes 25, 35 to secure the base plates 20, 30 to the adjacent jaws J. The fastener holes 25, 35 preferably have a recessed shelf recessed into the faces 22, 32 and the fasteners F have a sufficiently shallow head so that the head can reside within a recess above these shelves so that the heads of the fasteners F can be fully recessed when tightened. Fastener holes 25, 35 are preferably slightly oversized to facilitate some movement laterally and vertically of the base plates 20, 30 relative to the jaws J. Thus, mere attachment of the base plates 20, 30 to adjacent jaws J with the fasteners F does not precisely align the base plates 20, 30. Rather, other alignment procedures are called for and accommodated by the oversizing of these fastener holes 25, 35.

The standard base plate 20 includes bolt holes 28 passing perpendicular through the face 22 to the rear 26 near the top edge 24 of the base plate 20. These bolt holes 28 are preferably cylindrical in form and sized large enough to allow bolts B to pass therethrough. Preferably, some of these bolt holes 28 are fitted with pins 29 which press-fit into the bolt holes 28 and extend from the face 22 somewhat. The bolt holes 28 and pins 29 are preferably provided at a constant spacing extending along a horizontal line.

The slotted base plate 30 includes slots 38 near a top edge 34 thereof which extend horizontally and along a common line parallel with the top edge 34. The slots 38 preferably have a height similar to a diameter of the bolt holes 28 but are significantly wider. In the embodiments shown, eight bolt holes 28 are provided in each standard base plate 20 and four slots 38 are provided in each slotted base plate 30. Each slot 38 has a length similar to a distance between adjacent bolt holes 28 in the standard base plate 20. Bolts B can pass through either the bolt holes 28 or the slots 38 and attach to a soft jaw 40 for attachment of the soft jaw to the standard base plate 20 or slotted base plate 30.

With particular reference to FIGS. 1-6, basic details of the soft jaw 40 are described, according to a preferred embodiment. The soft jaw 40 is an elongate structure which preferably has a top side 42 opposite a bottom side and with a front side 46 opposite a rear side 44. Ends 41 are spaced apart by a length of the soft jaw 40. The soft jaw 40 is preferably formed of a softer material than that which forms the base plates 20, 30. For instance, the soft jaw 40 can be formed of aluminum while the base plates 20, 30 can be formed of steel. The soft jaw 40 can thus be quickly machined to exhibit a modified contour, such as a contour matching a portion of a geometry of a workpiece W.

Figure 6:
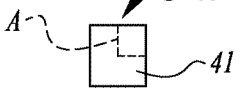
FIG. 6 is an end elevation view of the soft jaw of FIG. 3, with an optional angle cut shown in broken lines.

In FIGS. 1 and 2 the soft jaws 40 have been modified by including an angle cut A. Such an angle cut A is also depicted in FIG. 6 in broken lines. As an alternative, the soft jaw 40 can be modified with circle cuts C of a semi-cylindrical form (FIGS. 4 and 5), such as to allow the vise adapter system 10 to be particularly configured for holding workpieces that have circular or cylindrical contours. The modified contour of the soft jaw 40 is typically provided into a front side 46 and top side 42 of the soft jaw 40. The particular dimensions, shape and other characteristics of the modified contour of the soft jaw 40 are selected to match a geometry of a portion of a workpiece W to be held by the soft jaws 40. The soft jaws 40 thus provide a portion of a "jig" for securely holding a workpiece W and facilitating the rapid loading of a workpiece W into the vise V and precise locating of the workpiece W for accurate machining thereof.

Figure 7:
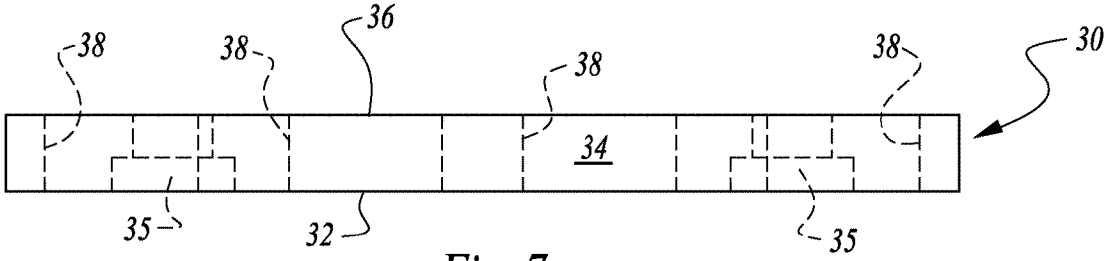
FIG. 7 is a top plan view of a slotted base plate according to this invention, with geometric features passing therethrough shown with hidden lines.
Figure 8:
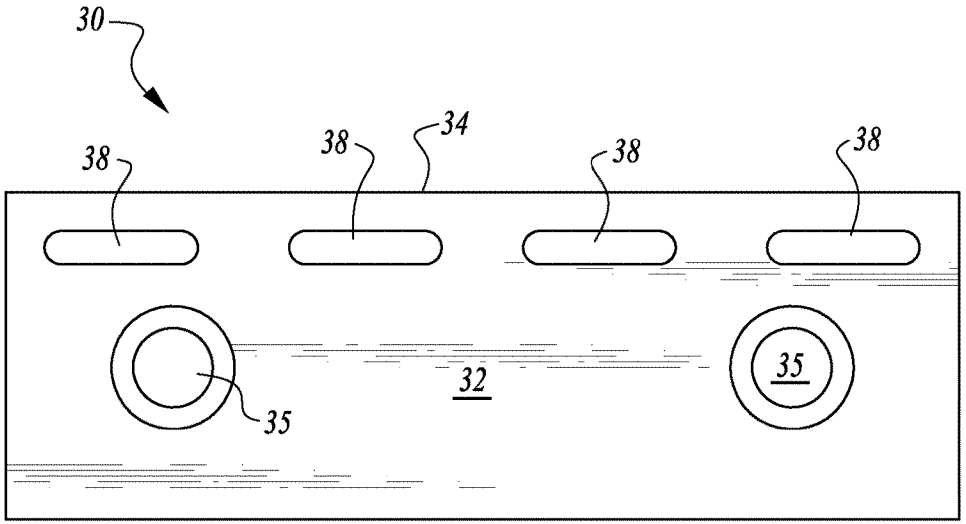
FIG. 8 is a front elevation view of the slotted base plate of FIG. 7.
Figure 9:
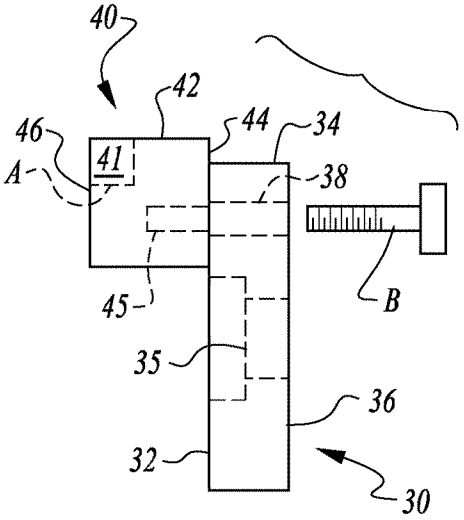
FIG. 9 is a side elevation view of the slotted base plate of FIGS. 7 and 8 and further including a soft jaw such as that depicted in FIGS. 3-6 attached thereto with a bolt.

The soft jaws 40 typically are modified once to be utilized in the machining of multiple workpieces W having the same machining operation to be performed. The soft jaws 40 can be kept in inventory to be reused whenever similar machining steps are required. Because the soft jaws 40 are formed of aluminum or other easily machinable material the soft jaws 40 can be quickly modified to provide the optimal contour for holding of the workpiece W. FIGS. 7-9 further illustrate structural details of the base plates 20, 30 and with FIG. 9 depicting the attachment of the soft jaw 40 to the slotted base plate 30 for secure holding of a workpiece W (FIGS. 1 and 2).

With particular reference to FIGS. 10-20, details of an alignment base plate 50 and associated locating pin 60 and soft jaw 70H, 70S are described, according to a further embodiment of this invention. The vise adapter system 10 benefits from having the base plates, such as alignment base plates 50, precisely aligned relative to each other and relative to a soft jaw, such as the slotted soft jaw 70S. As noted above, the fastener holes, such as the fastener holes 55 of the alignment base plate 50, do not precisely hold the base plate 50 to the adjacent jaws J. Rather, the fasteners F are slightly smaller than the size of the fastener holes 55 in the base plates 50 so that the base plates 50 can move somewhat laterally and vertically relative to the jaws J.

To facilitate alignment of the alignment base plates 50, a pair of alignment base plates 50 are provided on opposite jaws J. Alignment base plates 50 include alignment holes 53 passing therethrough. A locating pin 60 is provided with a diameter similar to a diameter of the alignment holes 53, and exhibiting a slip fit. Optionally, a notch 51 is formed in at least one of the jaws J which is also sized to receive a tip 62 of the locating pin 60 therein. Thus, a pair of alignment base plates 50 (or at least one) can be placed adjacent to opposite jaws J of a vise V and the locating pin 60 can pass through the alignment holes 53 in each of the base plates 50 and into the notch 51 in one of the jaws J (by closing the vise jaws J together enough to allow the locating pin 60 to pass into each of the alignment holes 53), so that the alignment base plates 50 are precisely aligned opposite each other.

The alignment base plate 50 otherwise has similar contour details as those of the base plates 20, 30 described in detail above. Thus, they include a face 52 opposite a rear 56 which are planar and parallel to each other, oriented in a vertical plane. A top edge 54 defines an uppermost portion of the base plate 50. Bolt holes 58 pass through the base plate 50 from the face 52 to the rear 56 near the top edge 54. Pins 59 can be provided which fit into pin holes 57 which are in line with the bolt holes 58 (shown in FIGS. 10 and 12 near each end of the row of bolt holes 58). A soft jaw 70H, which features pin bores 71 (FIGS. 17-20) can thus attach to the alignment base plate 50 in the same manner that the soft jaw 40 attached to the base plates 20, 30 as described above, except with the pins 59 fitting into the pin bores 71.

The soft jaw 70H, 70S includes a top side 72 opposite a bottom side and a rear side 74 opposite a front side 76. These opposite sides are preferably parallel to each other and spaced a similar distance so that the soft jaw 70H, 70S has a substantially square cross-section. In other embodiments, soft jaws having different geometric cross-sections (and various dimensions) could be provided. The soft jaw 70H, 70S includes an alignment bore 79 passing therethrough which is sized similarly to a diameter of the locating pin 60. Also, the slotted soft jaw 70 includes threaded bores 75 similar to the threaded bores 45 in the soft jaw 40.

The threaded bores 75 are provided in a line that includes the alignment bore 79 in a middle thereof. This pattern can repeat if longer soft jaws (see FIGS. 1-6) are to be provided. The pin bores 71 are also provided along this line (see FIG. 17). Preferably, the slotted soft jaw 70S features alignment slots 73 passing therethrough (rather than the pin bores 71), which can be aligned with the pins 59 extending from the alignment base plate 50 to further facilitate rapid attachment of the slotted soft jaw 70S to the alignment base plate 50. The locating pin 60 can then be used in the alignment bores 79 to line up the two soft jaws 70H, 70S.

In particular, the following procedure can be followed. After the locating pin 60 has been used to align the two alignment base plates 50, the soft jaw 70H is plated adjacent to one of the base plates 50. The pins 59 extending out of the pin holes 57 fit into the pin bores 71 in the soft jaw 70H to locate it precisely. Bolts B are used to further secure the soft jaw 70H to the base plate 50. Next, a slotted soft jaw 70S is placed adjacent to the other base plate 50, with the pins 59 extending off of the pin holes 57 in the base plate 50 extending into the alignment slots 73. The slots allow some lateral movement of the slotted soft jaw 70S. The locating pin 60 is then placed in one of the alignment bores 79 in one of the soft jaws 70H, 70S and the jaws J are moved together until the locating pin passes into the alignment bore 79 of the other soft jaw 70S, 70H. The bolts B can then be placed and tightened to hold the slotted soft jaw 70S.

Before placement of the workpiece W thereon, the same machining equipment associated with the vise V can be utilized to machine modified contours into the soft jaw 70H, 70S, such as by forming into the top side 72 and front side 76 of the soft jaw 70H, 70S. Once such contouring is complete and provided to match a geometry of a portion of a workpiece, the workpiece can then be placed between the soft jaws 70H, 70S for secure and precise positioning of the workpiece within the vise V. If this setup is taken down for some reason, it can be readily repeated by utilization of the locating pin 60 again along with the same soft jaws 70H, 70S which were provided with the modified contour for holding the particular workpiece. Alternatively, the modified contour can be formed into the soft jaws 70H, 70S or other soft jaws through a separate procedure, such as with the soft jaws 70H, 70S held within a vise V in a traditional fashion.

Figure 22:
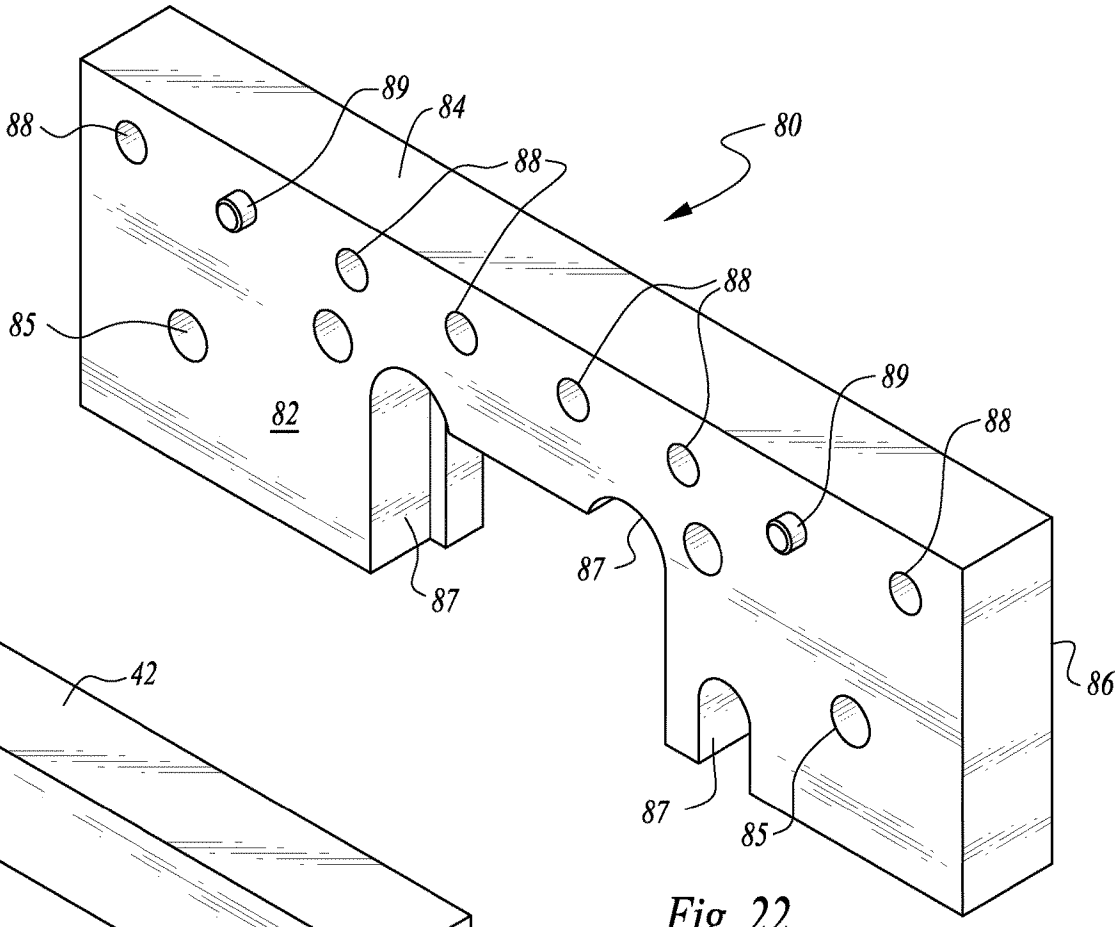
FIG. 22 is a perspective view of an arched base plate alternative to the base plates of FIGS. 1, 2 and 10-12.
Figure 21:
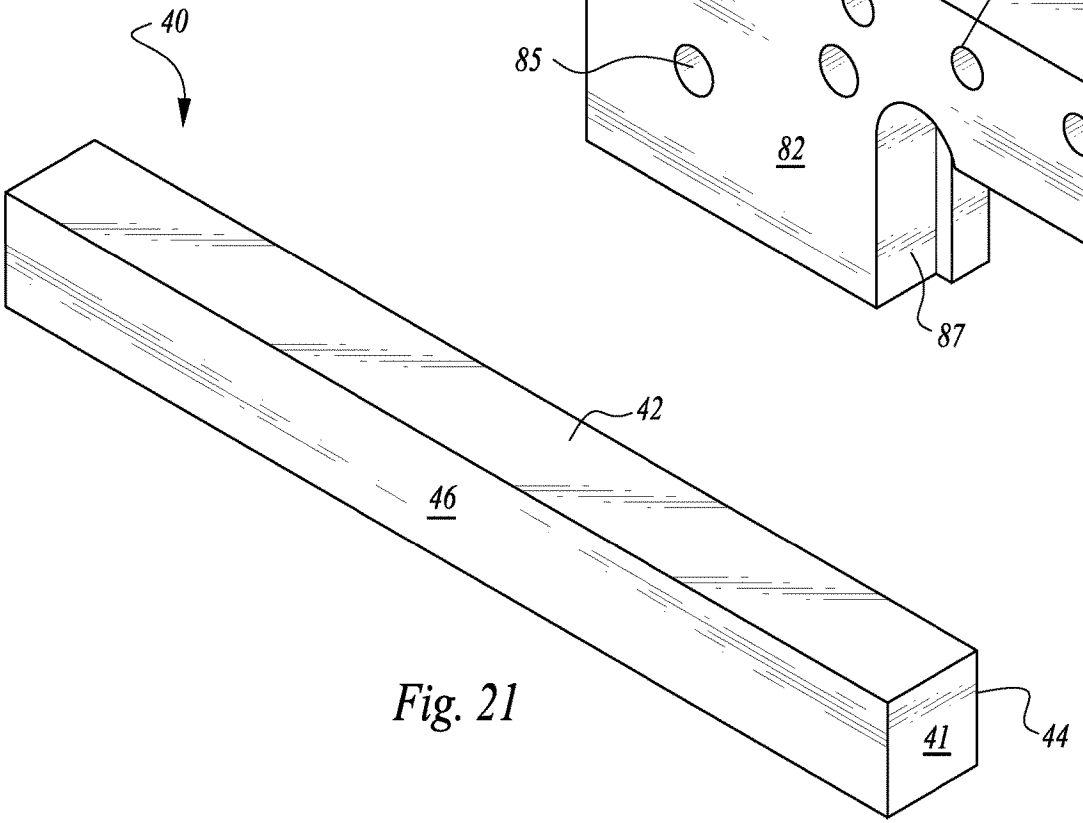
FIG. 21 is a perspective view of a soft jaw according to various embodiments of this invention, which can be cut to provide modified contours matching portions of a workpiece to be held.

FIGS. 21 and 22 depict how a soft jaw 40 can also be attached to an arched base plate 80. Some vises V have jaws J which benefit from utilization of an arched base plate 80 which includes clearance for portions thereof on a lower mid-area. Such an arched base plate 80 is generally similar to the base plates 20, 30, 50 described above including a planar face 82 opposite a planar rear 86 which are each oriented substantially vertically. A top edge 84 defines an uppermost portion of the arched base plate 80. Bolt holes 88 pass through the arched base plate 80 and allow for bolts B to hold a soft jaw 40 thereto. The arched base plate 80 also includes fastener holes 85 for attachment to a jaw J and a lower contour 87 unique to the arched base plate 80 to facilitate operation with particular jaws J which benefit from such contouring. Pins 89 can also extend from the arched base plate 80 to facilitate placement of the soft jaw 40 against the arched base plate 80.

Figure 25:
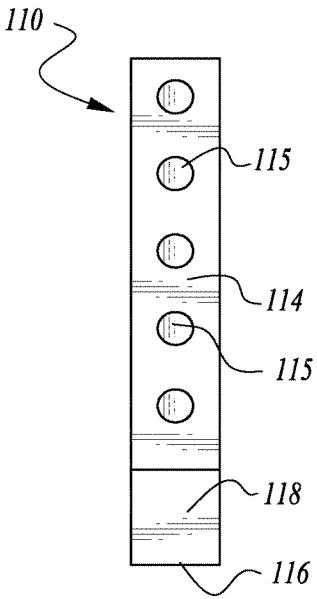
FIG. 25 is an end elevation view of that which is shown in FIGS. 23 and 24.
Figure 26:
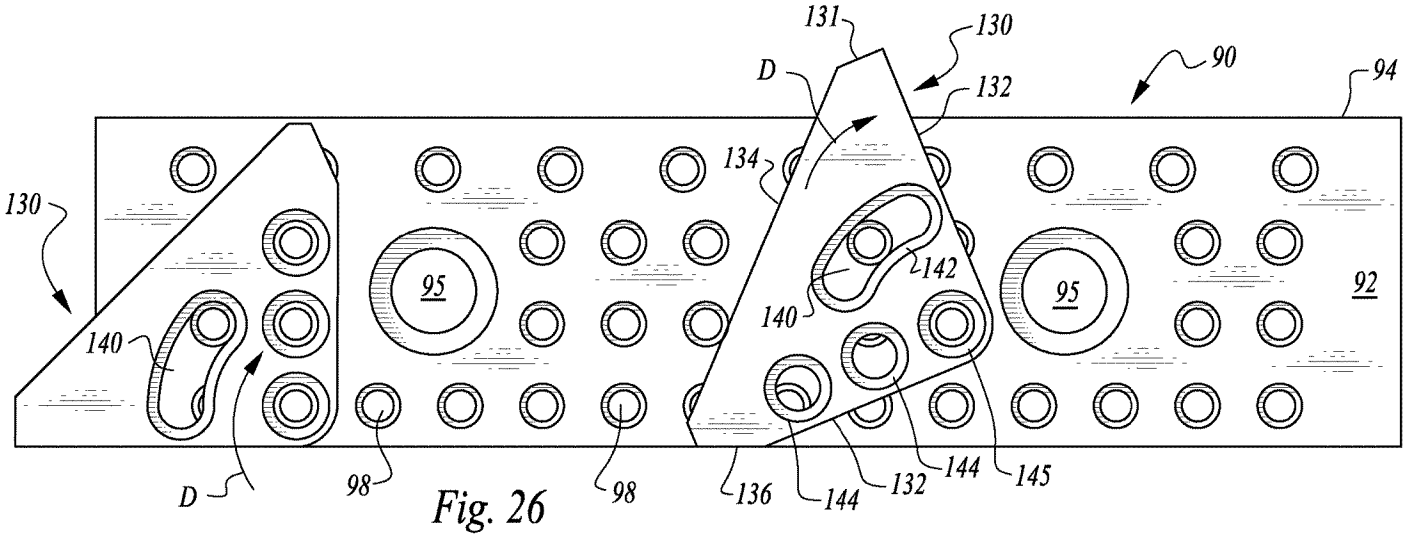
FIG. 26 is a front elevation view of a multi-hole base plate alternative to the base plates of previous figures and with multiple bolt holes therein and with adapters mounted to a front surface thereof and having various different angles presented on edges thereof.
Figure 27:
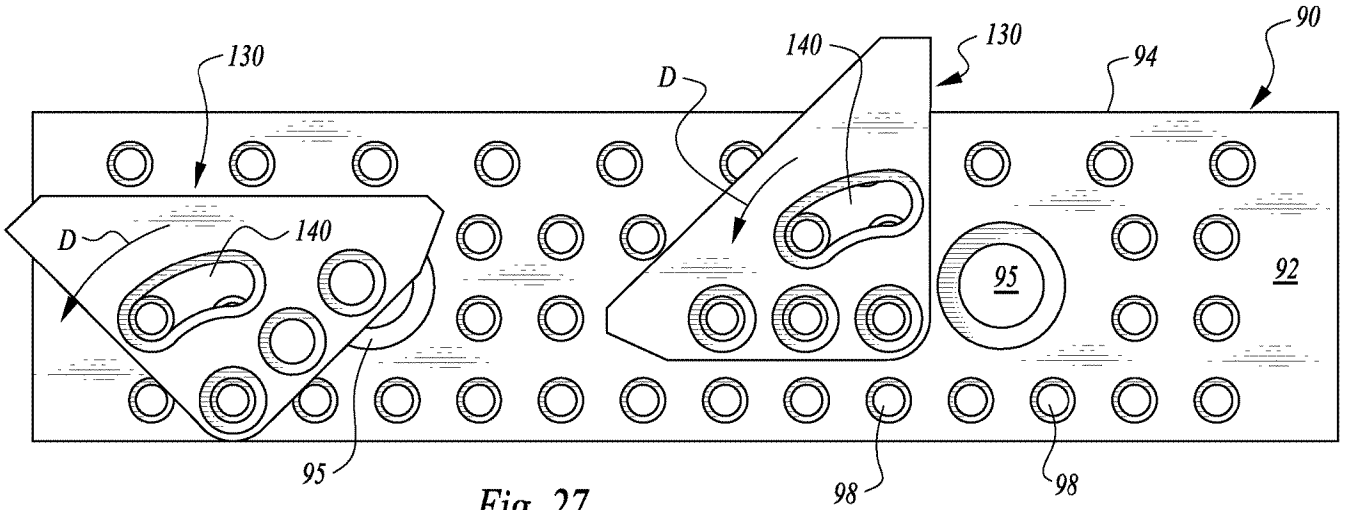
FIG. 27 is a front elevation view similar to that which is shown in FIG. 26, but with adapters rotated to further alternative positions.

FIGS. 26 and 27 depict a multi-hole base plate 90 similar to the base plates 20, 30, 50, 80, but featuring a plurality of bolt holes 98 passing through portions thereof. These bolt holes 98 are preferably recessed with a shelf to facilitate bolts B extending into a face 92 of the multi-hole base plate 90 and with heads of the bolts B remaining recessed after such attachment. While soft jaws 40, 70 can be attached to the multi-hole base plate 90, the multi-hole base plate 90 is also configured so that adapters 110, 130, 150 (FIGS. 23-30) can be attached to the multi-hole base plate 90. This base plate 90 includes fastener holes 95 for attachment to jaws J through fasteners F. A top edge 94 defines an uppermost portion of the base plate 90. The pattern of the bolt holes 98 can be any of a variety of different patterns with the embodiment depicted having a generally rectangular spacing for a plurality of lower bolt holes 98 over the face 92 of the multi-hole base plate 90, except near an upper edge where spacing is provided to match spacing for threaded bores 45 in a soft jaw 40. In this way, the multi-hole base plate 90 can be utilized either with soft jaws 40 or with the adapters 110, 130, 150.

Figure 23:
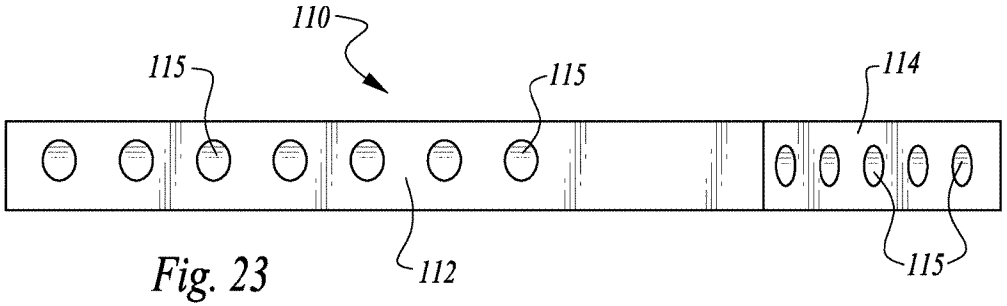
FIG. 23 is a top plan view of an adapter featuring edges which can be conveniently angled at 30° or 60°, and which can be attached to a base plate and rotated to various different angles.
Figure 24:
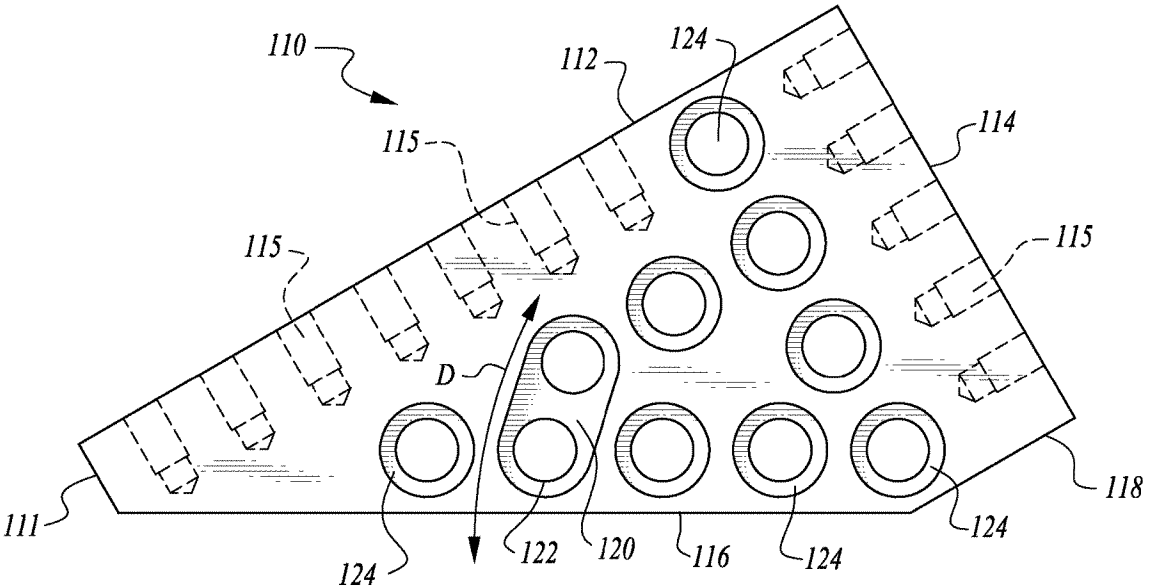
FIG. 24 is a front elevation view of that which is shown in FIG. 23.

With particular reference to FIGS. 23-25, details of a 30° adapter 110 are described. The 30° adapter 110 is a rigid monolithic structure configured to be attachable to a face 92 of the multi-hole base plate 90 or to other base plates on jaws J of a vise V. The 30° adapter 110 includes opposing parallel surfaces bounded by edges. These edges include a long edge 112, perpendicular to a short edge 114. A diagonal edge 116 extends between the long edge 112 and short edge 114. A bevel edge 118 is preferably provided where the diagonal edge 116 comes together with the short edge 114. A truncated tip 111 is preferably provided where the diagonal edge 116 comes together with the long edge 112.

Edge bores 115 extend into at least the long edge 112 and short edge 114 which can receive bolts B for attachment of soft jaws 40, stops or other jigs for supporting of a workpiece W. Preferably these edge bores 115 are similar to the threaded bores 45 in the soft jaw 40 so that the same bolts B can be utilized with both the edge bores 115 and the soft jaws 40.

The 30° adapter 110 can be formed of aluminum or other soft material to facilitate further machining thereof, but most typically is formed of steel and is primarily utilized to present the edges 112, 114, 116 having appropriate angular orientations. A recess 120 is provided on a portion of the 30° adapter. In this embodiment, this recess 120 is merely recessed into a portion of one of the surfaces of the adapter 110 which encompasses a pair of recessed holes 122 therein. Stepped holes 124 are provided elsewhere on the face of the 30° adapter 110. Various different recessed holes 122, 124 can be tightened to secure the 30° adapter 110 to an adjacent base plate once it has the desired orientation.

For instance, attachment as shown presents the long edge at a 30° angle to horizontal and the short edge 114 at a 60° angle to horizontal. If the holes 124 closest to the short edge 114 are oriented vertically and used to fasten to bolt holes 98 in the base plate 90 (FIGS. 26 and 27) then the short edge 114 is oriented vertically. Similarly, holes 124 a common distance from the long edge 112 can be attached to bolt holes 98 in a vertical alignment to present the long edge 112 in a vertical orientation.

With particular reference to FIGS. 26 and 27, details of a 90° adapter 130 are described. The 90° adapter 130 is shown upon the multi-hole base plate 90 and also generally illustrates how the 30° adapter 110 could be mounted to such a base plate 90. The 90° adapter 130 includes a pair of right angle edges 132 which are perpendicular to each other and a diagonal edge 134 extending between the right angle edges 132. A bevel edge 136 is provided at one of the ends of one of the right angle edges 132 adjacent the diagonal edge 134. Truncated tips 131 are also provided on at least one of the transitions between a right angle edge 132 and a diagonal edge 134.

A curving slot 140 is provided which has an arcuate form with a step 142 surrounding the curving slot 140. Bolts can pass into this curving slot 140 and engage the step 142. When the bolt is somewhat loose, the 90° adapter 130 can pivot about a somewhat loose bolt in a pivot hole 145, with a separate bolt residing within the curving slot 140. Once a desired position for the 90° adapter 130 is achieved, the bolt within the curving slot 140 (and the bolt within the pivot hole 145) can be tightened against the step 142 to secure the 90° adapter 130 in this position. Stepped holes 144 are also provided on portions of the 90° adapter 130 such as to hold the 90° adapter 130 in a position where it presents a vertical edge and a 45° angle edge for supporting workpieces of various different types. FIGS. 26 and 27 reveal various different orientations which can be achieved with the 90° adapter 130 and illustrate pivoting of the 90° adapter 130 (along arrow D of FIGS. 26 and 27) into various different orientations.

Figure 28:
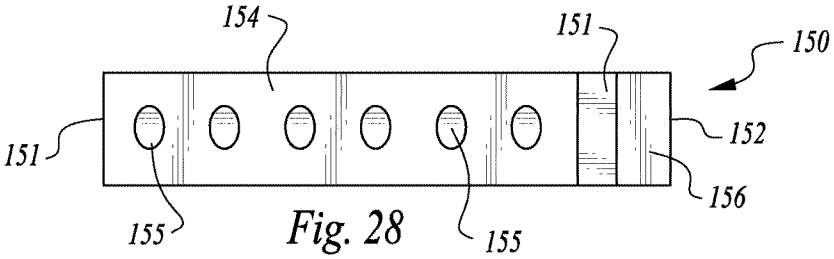
FIG. 28 is a top plan view of a 45° adapter having a diagonal surface conveniently locatable at a 45° angle to horizontal when attached to a base plate such as the multi-hole base plate of FIGS. 26 and 27.
Figure 29:
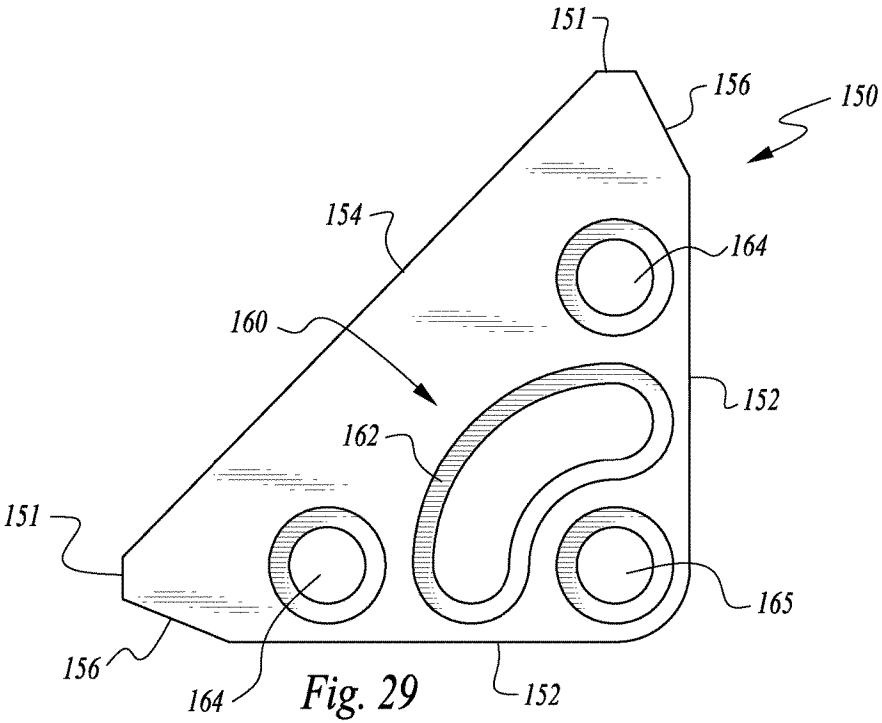
FIG. 29 is a front elevation view of that which is shown in FIG. 28.
Figure 30:
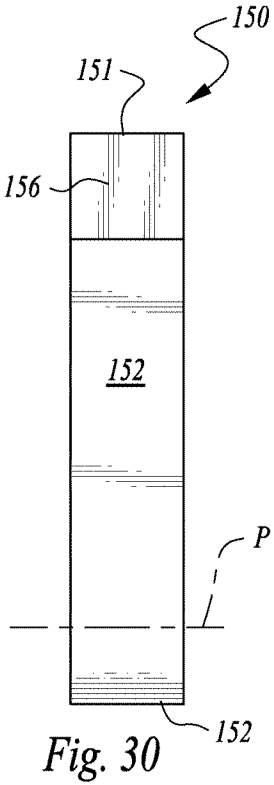
FIG. 30 is an end elevation view of that which is shown in FIGS. 28 and 29.

FIGS. 28-30 depict details of a 45° adapter 150 slightly different from the 90° adapter 130 of FIGS. 26 and 27. With the 45° adapter 150 a pair of parallel opposite surfaces are bounded by a pair of right angle edges 152 with a diagonal edge 154 extending between the right angle edges 152. A bevel edge 156 is provided at each of the right angle edges 152 where they transition to the diagonal edge 154, as well as truncated tips 151. Edges bores 155 are preferably provided extending into at least the diagonal edge 154 to facilitate attachment of other structures through bolts to this diagonal edge 154.

A curving slot 160 curves about a pivot hole 165 provided at a corner between the two right angle edges 152. This curving slot 160 includes a step 162 and can receive a bolt therein which allows the 45° adapter 150 to rotate when the bolt is loose and to be secured when the bolt within the curving slot 160 is tightened. Stepped holes 164 are also provided passing through the 45° adapter 150 for securing of the 45° adapter 150, particularly in certain standard orientations such as with the diagonal edge 154 presented at a 45° angle and with the right angle edges 152 provided either vertically or horizontally.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A method for holding a workpiece with a vise for machining, including the steps of:

identifying a vise having a pair of jaws with a base plate adjacent each jaw, the base plates having faces which are parallel and spaced from each other, at least one of the base plates having holes extending through the base plate near a top edge thereof;

identifying at least one elongate soft jaw having a plurality of threaded holes therein, at least two of the threaded holes similar in size and spacing to at least two of the holes passing through the base plate near the top edge;

evaluating surfaces of a workpiece to be held during machining of the workpiece;

cutting the soft jaw to have at least portions of the soft jaw exhibit modified contours matching portions of surfaces of the workpiece to be held, as determined by said evaluating step;

attaching the soft jaw to the base plate;

tightening the vise upon the workpiece with the surfaces of the workpiece held adjacent the modified contours of the soft jaw;

wherein said identifying a vise step includes at least one of the pair of jaws having a notch therein, wherein at least one of the base plates includes an alignment hole therein, the alignment hole sized similarly to the notch in the jaw; and placing a locating pin of elongate cylindrical form through the alignment hole in the base plate and into the notch in the jaw, the alignment pin aligning the base plate with the jaw before securing of the base plate to the jaw.

2. The method of claim 1 wherein said identifying steps include the holes in the base plate and the threaded holes in the soft jaw being equally spaced to each other to allow bolts to pass through the holes in the base plate and into the threaded holes in the soft jaw to hold the soft jaw to at least one of the base plates.

3. The method of claim 1 wherein said identifying steps include the soft jaw formed of a material softer than a material from which the base plates are made.

4. The method of claim 3 wherein said identifying steps include the soft jaw formed of aluminum and the base plates formed of steel.

5. The method of claim 1 wherein said soft jaw includes slots therein extending into a surface of the soft jaw having the threaded holes therein, at least one of the base plates include at least two pins extending therefrom, the pins located such that the pins reside within the slots in the soft jaw when the soft jaw is adjacent to the base plate and with the holes in the base plate aligned with the threaded holes in the soft jaw.

6. The method of claim 1 wherein the holes in the base plate are in the form of slots which are elongate in a horizontal direction.

7. The method of claim 1 wherein the holes in the base plate are cylindrical in form and sized similarly to the threaded holes in the soft jaw.

8. The method of claim 1 wherein said identifying a vise step includes both base plates having alignment holes therein sized to receive the locating pin passing therethrough while the alignment pin is also located within the notch in the jaw;

passing the locating pin through the alignment holes in the base plates and into the notch in at least one of the jaws; and securing the base plates to adjacent ones of the jaws with the locating pin in place to align the base plates precisely together.

9. The method of claim 1 wherein said identifying an elongate soft jaw step includes placing two soft jaws, one adjacent each base plate, the soft jaws each having an alignment bore passing therethrough, the alignment bore sized to receive the locating pin passing therethrough; and passing the locating pin through each of the alignment bores in the soft jaws to cause alignment of the soft jaws to each other.

10. A system for holding a workpiece with a vise for machining, the system comprising in combination:

a pair of base plates attachable to adjacent jaws of a vise, said base plates having faces which are parallel and spaced from each other, at least one of said base plates having holes extending through said base plate near a top edge thereof;

at least one elongate soft jaw having a plurality of threaded holes therein, at least two of said threaded holes similar in size and spacing to at least two of said holes passing through said base plate near said top edge;

said soft jaw provided with a modified contour matching at least a portion of a surface of a work piece to be held by the soft jaw;

a plurality of bolts passing through said holes in said base plate and into said threaded holes in said soft jaw to hold said soft jaw to at least one of said base plates;

wherein at least one of said vises has a notch therein on a side of said vise adjacent to one of said base plates, said base plate adjacent said jaw having said notch therein having an alignment hole passing therethrough, said alignment hole sized similar to a size of said notch; and a locating pin of elongate cylindrical form sized to pass through said alignment hole and into said notch, said locating pin extending substantially perpendicularly away from said jaw and perpendicular to said faces of said base plates.

11. The system of claim 10 wherein said holes in said base plate and said threaded holes in said soft jaw are equally spaced from each other a similar distance to allow said bolts to pass through said holes in said base plate and said threaded holes in said soft jaw to hold said soft jaw to at least one of said base plates.

12. The system of claim 10 wherein said at least one soft jaw includes a plurality of slots therein extending into a surface of said soft jaw having said threaded holes therein, said base plate including at least two pins extending therefrom, said pins located and sized to fit within said slots in said soft jaw with said threaded holes in said soft jaw aligned with said holes in said base plates.

13. The system of claim 10 wherein said holes in said base plates are elongate slots extending horizontally.

14. The system of claim 10 wherein each of said base plates includes alignment holes therein, each sized to receive said locating pin passing therethrough.

15. The system of claim 10 wherein said soft jaw is provided as one of a pair of soft jaws, each said soft jaw adjacent a base plate, each soft jaw including an alignment bore passing therethrough, said alignment bores sized to receive said locating pin passing therethrough, such that said locating pin can pass through each of said alignment bores in said soft jaws simultaneously to assist in alignment of the and soft jaws to each other before tightly securing said soft jaws to said base plates.

* * * * *